United States Patent [19]

Olmstead et al.

[11] Patent Number: 4,741,664

[45] Date of Patent: May 3, 1988

[54] PORTABLE PUMP

[75] Inventors: Ronald F. Olmstead, Fairview; H. David Bowes, Erie, both of Pa.

[73] Assignee: Thompson-Chemtrex, Inc., Erie, Pa.

[21] Appl. No.: 26,006

[22] Filed: Mar. 16, 1987

[51] Int. Cl.[4] ..... F01D 3/02

[52] U.S. Cl. ..... 415/98; 415/99; 415/102

[58] Field of Search ..... 415/97, 98, 99, 101, 415/102

[56] References Cited

U.S. PATENT DOCUMENTS

| | | | |
|---|---|---|---|
| 513,901 | 1/1894 | Eisler | 415/99 |
| 950,398 | 2/1910 | Menge | 415/97 |
| 2,971,468 | 2/1961 | McDoniel | 415/97 |
| 3,767,321 | 10/1973 | Layne | 415/110 |
| 4,627,790 | 12/1986 | Bowes et al. | 415/53 R |

FOREIGN PATENT DOCUMENTS

| | | | |
|---|---|---|---|
| 524979 | 5/1931 | Fed. Rep. of Germany | 415/97 |

*Primary Examiner*—L. I. Schwartz

*Attorney, Agent, or Firm*—Webb, Burden, Robinson & Webb

[57] ABSTRACT

An axial flow liquid pump comprises an outer tube, an inner tube positioned within the outer tube, and a driven shaft journaled within the inner tube. An impeller is secured near to the lower end of the shaft. A conduit delivers liquid to be pumped from the exterior of the outer tube to the lower end of the inner tube. The conduit is sized for permitting liquid to be drawn into said impeller such that the pressure in the vicinity of the lower end of the inner tube is equal or less than the pressure at the exterior of the outer tube near the conduit intake but sufficient not to draw air down through the inner tube.

10 Claims, 1 Drawing Sheet

PORTABLE PUMP

BACKGROUND

This invention is directed to a portable liquid pump.

The pump according to this invention is especially useful for emptying drums, say 55 gallon drums, filled with chemical solutions, plating solutions, and the like.

A feature of the pump is a neutral pressure zone at the bottom of the pump shaft and just above the impeller. This zone makes fragile and expensive seals about the drive shaft unnecessary. The need for complex mechanical and lip seals about the drive shaft is reduced because corrosive liquids are prevented from reaching the motor.

The entire pump is versatile having the capability of pumping liquids with densities up to at least 1.8 specific gravity and with viscosities up to at least 600 cps (centipoise).

U.S. Pat. No. 4,627,790 discloses a unique air seal for axial flow pumps. However, some applications cannot tolerate the entrainment of air in the liquids being pumped. U.S. Pat. No. 3,767,321 teaches an axial flow pump wherein an auxiliary impeller acts upon the liquid surrounding the drive shaft to balance the upward pressure created by the main impeller.

SUMMARY OF THE INVENTION

Briefly, according to this invention, there is provided an axial flow liquid pump comprising an outer tube having intake openings near one end for liquid to be pumped and an outlet opening near the opposite end. An inner tube is positioned within the outer tube and a driven shaft is journaled within the inner tube. An impeller, preferably a double impeller, is secured to the shaft. The double impeller has two impeller chambers consisting of a lower impeller chamber for receiving liquid through an axial intake and for delivering the liquid to the space between the inner and outer tubes and an upper impeller chamber for receiving liquid through an annular intake along the shaft and also for delivering the liquid to the space between the inner and outer tubes. The impeller is positioned so that the lower impeller chamber receives liquid directly from a first intake opening at the lower end of the outer tube and the upper impeller chamber receives liquid directly from a space adjacent the inner tube and from an intake opening in the outer tube. Where an impeller with a single chamber is used, the lower chamber described above is eliminated.

An extension of the inner tube is provided with at least one opening near the impeller for permitting liquid to be drawn into the space between the shaft and the inner tube extension adjacent the impeller. The opening is in communication with the exterior of the outer tube through conduit passing through the space between the inner and outer tubes. The openings and conduits are sized such that the pressure in the vicinity of the second impeller intake is insufficient to force liquid up the inner tube by pumping pressure but sufficient not to draw air down through the inner tube. In other words a neutral pressure zone is created at the base of the shaft. In yet other words, the pressure is equal or less than the pressure at the exterior of the outer tube near the conduit intake. A coupling is provided on the end of the shaft away from the impeller for engaging the shaft of a motor to drive the pump shaft.

According to the preferred embodiment, the inner tube has a long narrow portion with a bearing at its end near the impeller. Extending beyond the bearing is a unitary coupling piece comprising an extension of the outer tube an extension of the inner tube with conduits positioned therebetween connecting the exterior of the outer tube with the interior of the inner tube extension. The end of the outer tube adjacent the intake opening is partially closed off and is provided with a lower axial intake opening having a diameter less than the inner diameter of the outer tube. The impeller intake openings are on opposite sides of the impeller and cylindrical extensions surrounding both openings extend axially outwardly therefrom. The cylindrical extensions are arranged such that one cylindrical extension is telescoped inside the enlarged portion of the inner tube portion of the coupling piece and the other extension is telescoped within the intake opening of the outer tube. The end of the outer tube adjacent the impeller is shaped to change the direction of flow of the liquid being thrown radially out of the impeller chambers.

DRAWINGS

Further features and other objects and advantages of this invention will become clear from the following detailed description of the invention made with reference to the drawings in which FIG. 1 illustrates the overall configuration of a portable pump arranged to pump liquid out of a drum which is shown in section;

DESCRIPTION OF THE PREFERRED EMBODIMENTS

Figure 1:
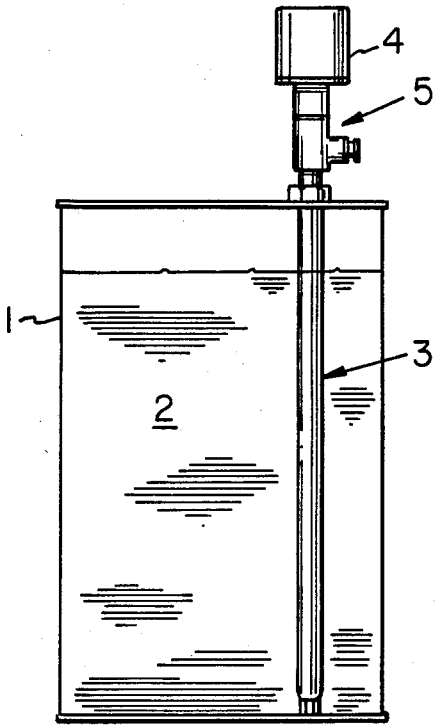

Referring now to FIG. 1, there is shown the typical arrangement of a portable pump according to this invention for emptying a drum 1 or corrosive liquid 2. This is but one of many uses and configurations. The pump comprises a submersible portion 3 and a pump motor 4 connected to an intermediate or exhaust section 5. As illustrated the pump is inserted through the cover 6 of the drum 1.

Figure 2:
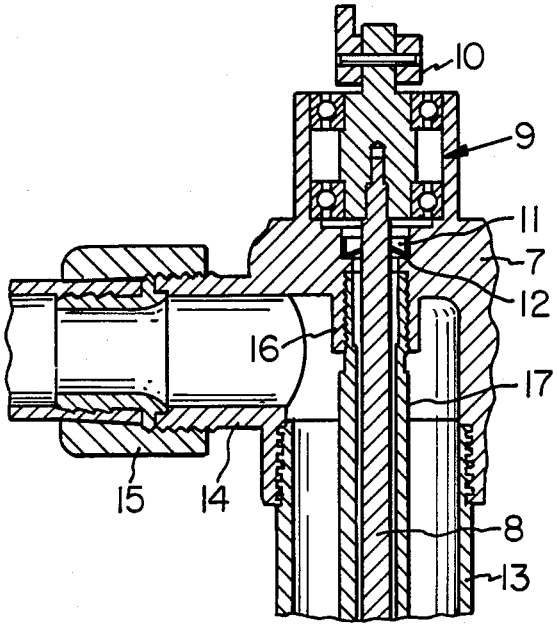
FIG. 2 illustrates in section the upper portion of a pump according to this invention.

Referring now to FIG. 2, there is shown the exhaust section 5 at the upper end of the submersible portion 3. The exhaust section comprises a headpiece 7 having an axial bore therein through which the driven shaft 8 passes. The headpiece supports the thrust bearing assembly 9 for the overhung shaft. The bearing sits in a cylindrical recess at the top of the headpiece and is secured in place by suitable means. An extension of the shaft above the bearing assembly has one-half of a coupling assembly 10. This allows a motor to be mounted on top of the headpiece with the output shaft of the motor coupled to the driven shaft 8.

Below the bearing is an annular space 11 for receiving an annular lip seal 12. This seal provides a measure of protection for the thrust bearing assembly 9 and the motor 4 from vapors that might rise up into the headpiece 7. The lower end of the headpiece has a large diameter bore with internal threads for receiving the external threads of the outer tube 13. A large diameter transverse boss 14 extends from the large diameter bore of the headpiece to form an elbow fitting. The boss 14 is shown with external threads for receiving a gland 15 that captures an exhaust conduit such as a flexible hose. The headpiece has an intermediate size bore surrounding the opening through which the shaft 8 passes. The intermediate size bore and internal boss 16 have internal threads for receiving the external threads of the inner tube 17. In an alternate embodiment the inner tube and the bore are simply provided with a force fit. The inner tube is spaced within the outer tube by the headpiece and by spacers 18 (see FIG. 3). During pumping, liquid is forced up between the inner and outer tubes and out through the transverse boss and conduit.

Figure 3:
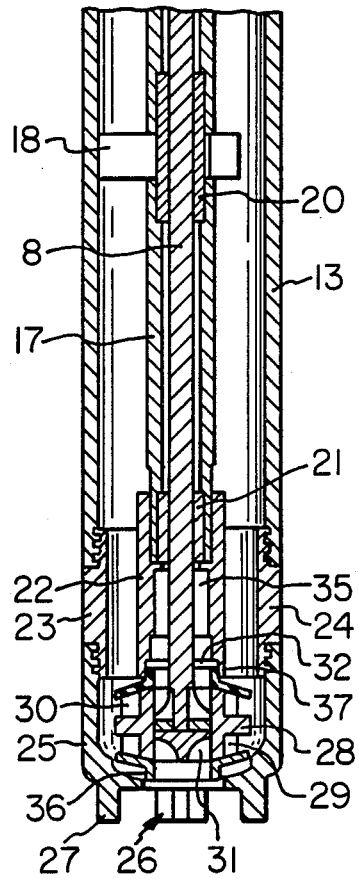
FIG. 3 illustrates in section the lower portion of a pump according to this invention.
Figure 4:
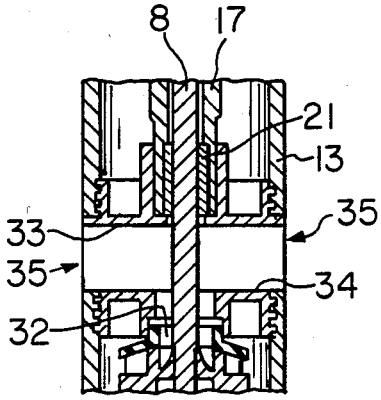
FIG. 4 illustrates a section of the lower portion of the pump taken at right angles to the section shown in FIG. 3.

Referring now to FIGS. 3 and 4 the lower end of the outer tube 13, the inner tube 17 and the shaft 8 are shown. A spacer 18 is shown between the inner tube and outer tube. At the location of the spacer, the inner tube is provided with a bearing 20 to position the inner tube 17 within the outer tube. The inner tube is made discontinuous at the location of the bearing 20 to enable the insertion of the bearing into seats comprising a bore of diameter somewhat greater than the inner diameter of the inner tube 17. The spacer 18 bridges the discontinuity and may have a force fit over the outer diameter of the inner tube.

Another bearing 21 between the shaft and the inner tube is shown at the lowermost end of the inner tube. It is seated in a bore that has a diameter slightly larger than the inner diameter of the inner tube. It is held in place by an extension 22 of the inner tube. The extension has a first bore that telescopes over the outer diameter of the inner tube and an annular flange that engages the end of the inner tube and the bearing 21. The extension 22 may be held in place by a force fit on the bottom of the inner tube.

The outer tube 13 is shown with internal threads at the lower end for receiving a coupling piece 23. The coupling piece comprises an outer cylindrical portion 24 with an inner and outer diameter similar to that of the outer tube. The outer cylindrical portion 24 of the coupling piece is provided with two sets of external threads. With one set of threads it is joined to the outer tube 13. An impeller housing 25 has internal threads that allow it to be secured to the outer cylindrical portion of the coupling 24. The impeller housing is provided with a lower intake opening 26 at the bottom thereof for receiving the liquid to be pumped. The impeller housing has external legs 27 to space the bottom of the impeller housing from the bottom of the container in which it is placed to insure that the lower intake opening is unobstructed. The interior of the impeller housing is shaped to direct liquid up the space between the inner and outer tubes.

Secured to the bottom of the shaft 8 is a double impeller 28. The impeller has two impeller chambers 29 and 30. The lower impeller chamber 29 receives liquid in a lower axial intake opening 31 and delivers the liquid to the space between the inner and outer tubes. The upper impeller chamber 30 receives liquid though an annular intake space 32 along the shaft and also delivers the liquid to the space between the inner and outer tubes. The impeller is positioned so that the lower impeller chamber 29 receives liquid directly from the intake lower opening 26 and the upper impeller chamber 30 receives liquid through conduit 33, 34 (see FIG. 4) extending between the outer cylindrical portion 24 of the coupling piece and the extension 22 of the inner tube. The coupling piece 23 may comprise one molded piece which includes the outer cylindrical portion 24, the extension 22 and the conduit 33 and 34.

The inner tube extension is provided with sized openings 35 near the impeller for permitting liquid to be drawn into the space within the inner tube extension 22 adjacent the impeller. The openings and the conduit 33, 34 are sized such that the pressure in the vicinity of the upper impeller intake 32 is insufficient to prevent liquid from being forced up the inner tube but sufficient not to draw air down through the inner tube. In other words, a neutral pressure zone is created at the base of the shaft. The determination of the size of the openings 35 and the conduit 33 and 34 is a matter of trial and error. For a given impeller the size is increased at least until air is no longer drawn down the inner tube.

The impeller intake openings 31 and 32 are on opposite sides. Cylindrical flanges or bosses 36 and 37 surround both openings and extend axially outwardly therefrom. The cylindrical bosses are arranged such that one boss is telescoped inside the inner tube extension 22 and the other boss is telescoped within the lower intake opening 26. The interior wall of the impeller housing is shaped to change the direction of flow of the liquid being thrown radially out of the impeller chambers.

The materials of construction are not a limiting feature of this invention. The shaft may be Inconel 625 known for its strength and corrosion resistance. The inner and outer tubes may be extruded polypropylene tubes that have been machined to provide threads. The bearings may be filled Teflon (fluorinated polyvinyls, etc.). The remaining parts, except the hose, may be molded polypropylene. The use of extruded and molded parts results in a relatively economical structure. The lip seal is a suitable elastomer chosen to resist corrosive atmospheres.

In the embodiment illustrated in FIGS. 3 and 4, the conduit 33 and 34 extend radially outward from the openings 35 and open to the exterior of the outer tube a distance above the lower end of the tube. This is a preferred construction. However, one or more conduit will suffice. Moreover, numerous routings of the conduit 33 and 34 are acceptable. For example, the conduit may turn downward and open from the outer tube nearer to the lower end of the outer tube. This would be preferable in the embodiment wherein only an impeller chamber is used. With the embodiment illustrated in FIGS. 3 and 4, when fluid is pumped down below the intake openings for conduit 33 and 34, the lower impeller chamber 29 will continue to draw fluid up from the lower intake opening while it is available. For this reason, the allowance between the cylindrical flange 37 and the inner diameter of the extension 22 should be minimized to avoid excessive leakage through the space to the conduit 33 and 34.

Having thus described our invention with the detail and particularity required by the Patent Laws, what is claimed and desired to be protected by Letters Patent is set forth in the following claims.

We claim:

1. An axial flow liquid pump comprising an outer tube having upper and lower ends and intake openings near the lower end for liquid to be pumped and an outlet opening near the upper end, an inner tube positioned within the outer tube and extending substantially the entire length of the outer tube and having upper and lower ends, a driven shaft journaled within the inner tube and having upper and lower ends, a double impeller secured near the lower end of the shaft, said impeller having two impeller chambers consisting of a lower impeller chamber for receiving liquid in an axial opening and delivering the liquid to the space between the inner and outer tubes and an upper impeller chamber for receiving liquid through an annular space along the shaft and delivering the liquid to the space between the inner and outer tubes, conduit means for delivering liquid to be pumped from the exterior of the outer tube to the annular space, said impeller being positioned so that the lower impeller chamber receives liquid directly from an intake opening near the lower end of the outer tube and the upper impeller chamber receives liquid directly from said conduit means, said conduit means sized for permitting liquid to be drawn into said upper impeller chamber such that the pressure in the vicinity of the upper impeller chamber intake is equal or less than the pressure at the exterior of the outer tube near the conduit intake but sufficient not to draw air down through the inner tube, and means on the upper end of the shaft for engaging the shaft of a motor to drive the pump shaft.

2. A pump according to claim 1 wherein the conduit means extends substantially radially relative to the shaft and between the inner and outer tubes placing the inner tube in communication with the exterior of the outer tube.

3. A pump according to claim 1 wherein the inner tube comprises an upper portion and a lower extension, the outer tube comprises a lower impeller housing, an intermediate portion and an upper portion, the impeller housing being separately formed and a unitary coupling piece defining the lower extension of the inner tube, the intermediate portion of the outer tube and the conduit means being separately formed, and said impeller housing, coupling piece and upper portion of the outer tube being suitably joined together about the impeller and shaft.

4. A pump according to claim 3 wherein the impeller housing, coupling piece and upper portion of the outer tube are releasably joined together.

5. A pump according to claims 1, 2, 3, or 4 wherein the impeller has intake openings on opposite sides and cylindrical flanges surround both openings and extend axially outwardly therefrom, said cylindrical flanges arranged such that one flange is telescoped inside the inner tube and the other flange is telescoped within an intake opening.

6. An axial flow liquid pump comprising an outer tube having upper and lower ends and at least one intake opening near the lower end for liquid to be pumped and an outlet opening near the upper end, an inner tube positioned within the outer tube and extending substantially the entire length of the outer tube and having upper and lower ends, a driven shaft journaled within the inner tube and having upper and lower ends, an impeller secured near the lower end of the shaft, said impeller having a chamber for receiving liquid down flowing through an annular space along the shaft and delivering the liquid to the space between the inner and outer tubes, conduit means for delivering liquid to be pumped from the exterior of the outer tube to the annular space having an intake opening through the outer tube, said impeller being positioned so the impeller chamber receives liquid directly from said conduit means, said conduit means sized for permitting liquid to be drawn into said impeller chamber such that the pressure in the vicinity of the impeller chamber intake is equal or less than the pressure at the exterior of the outer tube near the conduit intake but sufficient not to draw air down through the inner tube, means on the upper end of the shaft for engaging the shaft of a motor to drive the pump shaft.

7. A pump according to claim 6 wherein the conduit means extends substantially radially relative to the shaft and between the inner and outer tubes placing the inner tube in communication with the exterior of the outer tube.

8. A pump according to claim 6 wherein the inner tube comprises an upper portion and a lower extension, the outer tube comprises a lower impeller housing, an intermediate portion and an upper portion, the impeller housing being separately formed and a unitary coupling piece defining the lower extension of the inner tube, the intermediate portion of the outer tube and the conduit means being separately formed, and said impeller housing, coupling piece and upper portion of the outer tube being suitably joined together about the impeller and shaft.

9. A pump according to claim 6 wherein the impeller housing, coupling piece and upper portion of the outer tube are releasably joined together.

10. A pump according to claims 6, 7, 8, or 9 wherein the impeller has a cylindrical flange surrounds the opening and extends axially outwardly therefrom, said cylindrical flange arranged to be telescoped inside the inner tube.

* * * * *